US005944108A

United States Patent [19]

Baugh et al.

[11] Patent Number: 5,944,108

[45] Date of Patent: Aug. 31, 1999

[54] METHOD FOR MULTI-LATERAL COMPLETION AND CEMENTING THE JUNCTURE WITH LATERAL WELLBORES

[75] Inventors: John L. Baugh, Houston; David E. Hirth, Pasadena; Douglas J. Murray, Humble, all of Tex.

[73] Assignee: Baker Hughes Incorporated, Houston, Tex.

[21] Appl. No.: 08/919,898

[22] Filed: Aug. 28, 1997

Related U.S. Application Data

[60] Provisional application No. 60/025,161, Aug. 29, 1996.

[51] Int. Cl.[6] ..... E21B 43/14

[52] U.S. Cl. ..... 166/313; 166/50; 166/117.6

[58] Field of Search ..... 166/50, 313, 117.6, 166/120, 384, 117.5, 382

[56] References Cited

U.S. PATENT DOCUMENTS

| | | |
|---|---|---|
| 2,397,070 | 3/1946 | Zublin . |
| 2,452,920 | 11/1948 | Gilbert . |
| 2,797,893 | 7/1957 | McCune et al. . |
| 2,942,671 | 6/1960 | Schramm . |
| 3,330,349 | 7/1967 | Owsley et al. . |
| 3,332,493 | 7/1967 | Jones . |
| 4,396,075 | 8/1983 | Wood et al. . |
| 4,402,551 | 9/1983 | Wood et al. . |
| 4,415,205 | 11/1983 | Rehm et al. . |
| 4,436,165 | 3/1984 | Emery . |
| 4,444,276 | 4/1984 | Peterson, Jr. . |
| 4,573,541 | 3/1986 | Josse et al. . |
| 4,742,871 | 5/1988 | Miffre . |
| 4,807,704 | 2/1989 | Hsu et al. . |
| 5,289,876 | 3/1994 | Graham . |
| 5,301,760 | 4/1994 | Graham . |
| 5,318,122 | 6/1994 | Murray et al. . |
| 5,337,808 | 8/1994 | Graham . |
| 5,458,209 | 10/1995 | Hayes et al. . |
| 5,474,131 | 12/1995 | Jordan, Jr. et al. . |
| 5,477,925 | 12/1995 | Trahan et al. . |
| 5,526,880 | 6/1996 | Jordan, Jr. et al. . |

*Primary Examiner*—Frank Tsay
*Attorney, Agent, or Firm*—Cantor Colburn LLP

[57] ABSTRACT

The present invention relates to an improved method for multilateral completion and cementing (i.e., sealing) the juncture between primary and lateral wellbores. The completion method of the present invention addresses the issue of cementation and sealing of junctures between vertical and lateral wellbores. It is desirable to have the ability to re-enter each lateral wellbore as well as maintain the option to perform any function that could be done in a single wellbore. For this reason, cemented and sealed lateral wellbores are desirable so that normal isolation, stimulation or any other operation can be achieved. The method allows sealing and reworking of either wellbores with single laterals or multiple laterals and provides safe durable junctions therebetween. The method of this invention utilizes a "hook" liner hanger system. The Hook liner hanger system includes a novel camming surface and guide slot which cooperates with a complimentary control lug to selectively direct a tool in a primary or lateral wellbore.

8 Claims, 10 Drawing Sheets

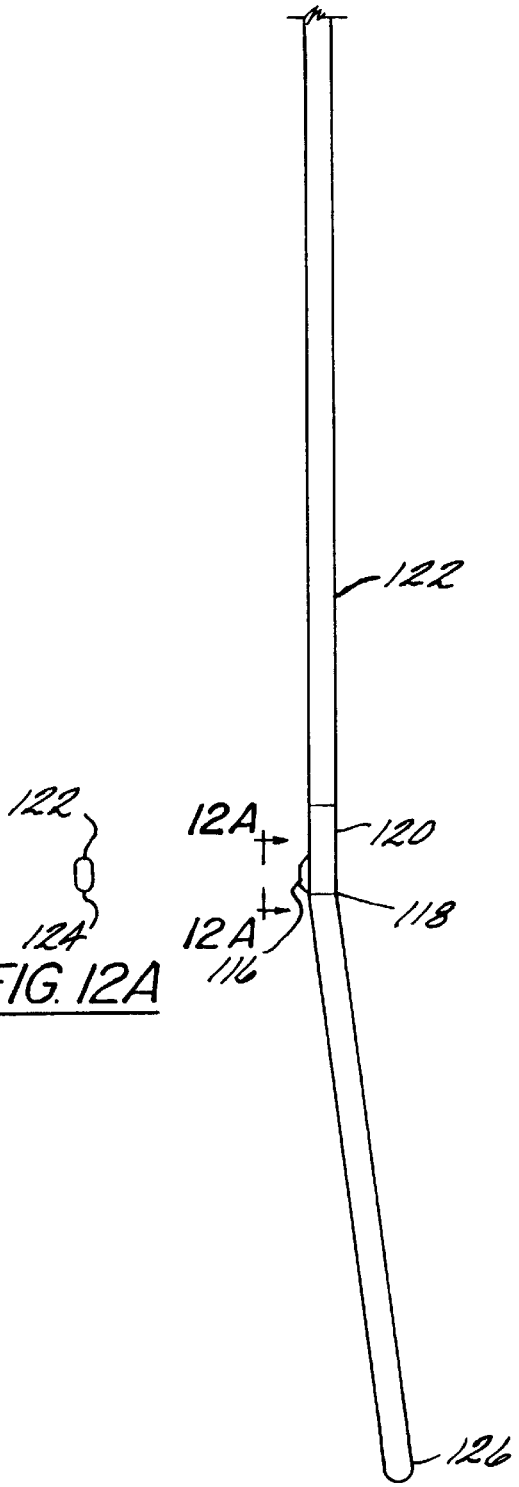
FIG. 12A
FIG. 12
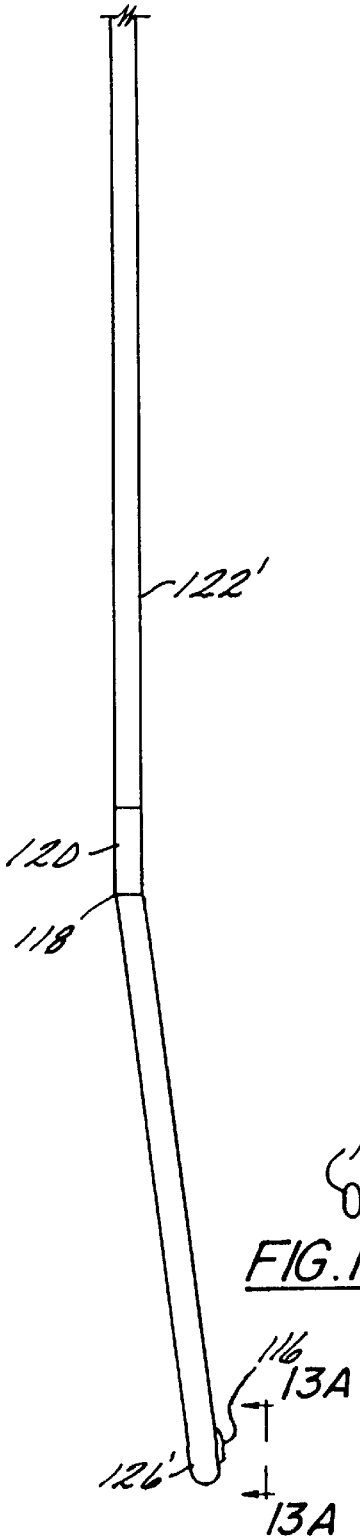
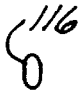
FIG. 13A
FIG. 13

METHOD FOR MULTI-LATERAL COMPLETION AND CEMENTING THE JUNCTURE WITH LATERAL WELLBORES

CROSS-REFERENCE TO RELATED APPLICATIONS

This application claims the benefit of U.S. Provisional Application Ser. No. 60/025,161 filed Aug. 29, 1996.

BACKGROUND OF THE INVENTION

This invention relates generally to the completion of wellbores. More particularly, this invention relates to new and improved methods and devices for completion of a branch wellbore extending laterally from a primary well which may be vertical, substantially vertical, inclined or even horizontal. This invention finds particular utility in the completion of multilateral wells, that is, downhole well environments where a plurality of discrete, spaced lateral wells extend from a common vertical wellbore.

Horizontal well drilling and production have been increasingly important to the oil industry in recent years. While horizontal wells have been known for many years, only relatively recently have such wells been determined to be a cost effective alternative (or at least companion) to conventional vertical well drilling. Although drilling a horizontal well costs substantially more than its vertical counterpart, a horizontal well frequently improves production by a factor of five, ten, or even twenty in naturally fractured reservoirs. Generally, projected productivity from a horizontal well must triple that of a vertical hole for horizontal drilling to be economical. This increased production minimizes the number of platforms, cutting investment and operational costs. Horizontal drilling makes reservoirs in urban areas, permafrost zones and deep offshore waters more accessible. Other applications for horizontal wells include periphery wells, thin reservoirs that would require too many vertical wells, and reservoirs with coning problems in which a horizontal well could be optimally distanced from the fluid contact.

Some horizontal wells contain additional wells extending laterally from the primary vertical wells. These additional lateral wells are sometimes referred to as drainholes and vertical wells containing more than one lateral well are referred to as multilateral wells. Multilateral wells are becoming increasingly important, both from the standpoint of new drilling operations and from the increasingly important standpoint of reworking existing wellbores including remedial and stimulation work.

As a result of the foregoing increased dependence on and importance of horizontal wells, horizontal well completion, and particularly multilateral well completion have posed important concerns and have provided (and continue to provide) a host of difficult problems to overcome. Lateral completion, particularly at the juncture between the vertical and lateral wellbore is extremely important in order to avoid collapse of the well in unconsolidated or weakly consolidated formations. Thus, open hole completions are limited to competent rock formations; and even then open hole completion is inadequate since there is no control or ability to re-access (or reenter the lateral) or to isolate production zones within the well. Coupled with this need to complete lateral wells is the growing desire to maintain the size of the wellbore in the lateral well as close as possible to the size of the primary vertical wellbore for ease of drilling and completion.

Conventionally, horizontal wells have been completed using either slotted liner completion, external casing packers (ECP's) or cementing techniques. The primary purpose of inserting a slotted liner in a horizontal well is to guard against hole collapse. Additionally, a liner provides a convenient path to insert various tools such as coiled tubing in a horizontal well. Three types of liners have been used namely (1) perforated liners, where holes are drilled in the liner, (2) slotted liners, where slots of various width and depth are milled along the liner length, and (3) prepacked liners.

Slotted liners provide limited sand control through selection of hole sizes and slot width sizes. However, these liners are susceptible to plugging. In unconsolidated formations, wire wrapped slotted liners have been used to control sand production. Gravel packing may also be used for sand control in a horizontal well. The main disadvantage of a slotted liner is that effective well stimulation can be difficult because of the open annular space between the liner and the well. Similarly, selective production (e.g., zone isolation) is difficult.

Another option is a liner with partial isolations. External casing packers (ECPs) have been installed outside the slotted liner to divide a long horizontal well bore into several small sections. This method provides limited zone isolation, which can be used for stimulation or production control along the well length. However, ECP's are also associated with certain drawbacks and deficiencies. For example, normal horizontal wells are not truly horizontal over their entire length, rather they have many bends and curves. In a hole with several bends it may be difficult to insert a liner with several external casing packers.

Finally, it is possible to cement and perforate medium and long radius wells are shown, for example, in U.S. Pat. No. 4,436,165.

While sealing the juncture between a vertical and lateral well is of importance in both horizontal and multilateral wells, re-entry and zone isolation is of particular importance and pose particularly difficult problems in multilateral well completions. Re-entering lateral wells is necessary to perform completion work, additional drilling and/or remedial and stimulation work. Isolating a lateral well from other lateral branches is necessary to prevent migration of fluids and to comply with completion practices and regulations regarding the separate production of different production zones. Zonal isolation may also be needed if the borehole drifts in and out of the target reservoir because of insufficient geological knowledge or poor directional control; and because of pressure differentials in vertically displaced strata as will be discussed below.

When horizontal boreholes are drilled in naturally fractured reservoirs, zonal isolation is seen as desirable. Initial pressure in naturally fractured formations may vary from one fracture to the next, as may the hydrocarbon gravity and likelihood of coning. Allowing them to produce together permits crossflow between fractures and a single fracture with early water breakthrough jeopardizes the entire well's production.

As mentioned above, initially horizontal wells were completed with uncemented slotted liners unless the formation was strong enough for an open hole completion. Both methods make it difficult to determine producing zones and, if problems develop, practically impossible to selectively treat the right zone. Today, zone isolation is achieved using either external casing packers on slotted or perforated liners or by conventional cementing and perforating.

The problem of lateral wellbore (and particularly multilateral wellbore) completion has been recognized for many years as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g., re-entry) a lateral subsequent to completion thereof. U.S. Pat. No. 3,330,349 discloses a mandrel for guiding and completing multiple horizontal wells. U.S. Pat. No. 5,318,122, which is assigned to the assignee hereof and incorporated herein by reference, discloses deformable devices that selectively seal the juncture between the vertical and lateral wells using an inflatable mold which utilizes a hardenable liquid to form a seal, expandable memory metal devices or other devices for plastically deforming a sealing material. U.S. Pat. Nos. 4,396,075; 4,415,205; 4,444,276 and 4,573,541 all relate generally to methods and devices for multilateral completion using a template or tube guide head. Other patents and patent applications of general interest in the field of horizontal well completion include U.S. Pat. Nos. 2,452,920; 4,402,551; 5,289,876; 5,301,760; 5,337,808; 5,458,209; 5,526,880; and 5,474,131, the latter two patents being commonly assigned and incorporated herein by reference.

U.S. Pat. No. 5,477,925, which is also commonly assigned to the assignee hereof and incorporated herein by reference discloses an improved method relating to multilateral completion and cementing (e.g., sealing) the juncture with lateral wellbores. The completion method of U.S. Pat. No. 5,477,925 addresses the issue of creating a window in the vertical hole, drilling a lateral wellbore and then sealing the juncture between the lateral and vertical wellbores to maintain the option to perform any function that could be done in a single wellbore as is desired for normal isolation, stimulation or any other required operation.

The '925 method comprises the use of a standard whipstock to mill out a window in the casing of the vertical wellbore by known methods after which a lateral wellbore is drilled prior to the running in of a novel "hook" liner system. Alternatively, the window can be preformed in the casing at the surface and then run-in to the appropriate depth. In either case, the '925 patent discloses a method for completing a primary wellbore having a first window therethrough and at least one lateral wellbore extending from the first window, comprising the steps of:

a) delivering a liner assembly into the primary wellbore and the lateral wellbore, the liner assembly including a hook hanger to engage the first window and the liner assembly including a second window therethrough for permitting passage from said liner assembly to the primary wellbore;

b) setting the hook hanger onto the first window; and c) delivering to the lateral wellbore a cementing assembly wherein cement is delivered to an annulus defined by a space between the line and the lateral wellbore at the junction of the primary wellbore and the lateral wellbore.

Notwithstanding the above-described attempts at obtaining cost effective and workable lateral well completions, there continues to be a need for new and improved methods and devices for providing such completions, particularly sealing between the juncture of vertical and lateral wells, the ability to re-enter lateral wells particularly in multilateral systems) and achieving zone isolation between respective lateral wells in a multilateral well system. More particularly, there continues to be a need for suitable devices which selectively enter a primary or lateral borehole (as desired) for re-entry and other purposes.

SUMMARY OF THE INVENTION

In accordance with the present invention, an improved method relating to multilateral completion and cementing (i.e., sealing) the juncture with lateral wellbores is presented. The completion method of the present invention addresses the issue of creating a window in the vertical hole, drilling a lateral wellbore and then sealing the juncture between the lateral and vertical wellbores to have the ability to re-enter each lateral wellbore as well as to maintain the option to perform any function that could be done in a single wellbore. For this reason, cemented lateral wellbores are desirable so that normal isolation, stimulation or any other operation can be achieved.

In accordance with the method of the present invention, prior to running in a novel "hook" liner system described hereinafter, a standard whipstock is used to mill out a window in the side of the casing of the vertical wellbore at the location where it is desired to drill a lateral wellbore. This is done by known methods. The lateral wellbore is then drilled by known methods to the total depth desired. Alternatively, the casing could include a pre-formed window. In addition, the lateral may have been previously formed therefore precluding the need for the steps of drilling the lateral wellbore.

The "hook" liner hanger system in accordance with this invention includes a "hook" as well as a unique cam at its leading edge (that surface which is first encountered by a tool string run in from the surface) that terminates in a guide slot which is designed to receive a guide slot protrusion mounted on a bent sub or at the bottom of the tool string depending on whether it is desired to enter a selected lateral wellbore or the main wellbore.

The "hook" liner hanger system in accordance with this invention includes a "hook" and is run into the wellbore and then through the aforementioned or preferred milled window by known standard methods. Entering the lateral hole with the bottom of the "hook" liner hanger system is accomplished by using known standard orientation methods, or by utilizing a known bent sub. The "hook" liner hanger system is run into the lateral wellbore until the "hook" hanger locates on the window in the main vertical wellbore. Inside the "hook" liner hanger system is a tail pipe assembly with adjustable opposing swab cups. The tail pipe assembly is capable of carrying liquid cement or other fluids as required to inflate external casing packers or other devices as required. The end of the "hook" hanger liner is then plugged to allow the hydraulic set hanger to set by means of applied pressure. An external casing packer located near the end of the "hook" liner hanger system is then inflated to seal the lateral wellbore annular space just below the cementing valve of the "hook" liner hanger system. Opposing "swab-cups" are used to direct fluid to inflate the external casing packer.

Once the inflatable external casing packer is set, the opposing "swab cups" are moved up hole in the lateral wellbore until the "swab cups" straddle the ports (holes) in a cementing valve. Pressure is then applied in a known manner to open the cementing valve and then cement is pumped in to fill the area of the annular space extending from the top of the inflatable external casing packer up to the milled window at the intersection of the primary wellbore and the lateral wellbore. In accordance with an important feature of this invention, the "hook" liner hanger system preferably has a premilled window for allowance of vertical reentry into the primary wellbore below the juncture of the lateral wellbore and the primary wellbore.

Next, the external casing packer that is located up hole in the primary wellbore above the junction of the primary wellbore and lateral wellbore discussed above is set using known mechanical hydraulic or other known methods. The tailpipe assembly string is then withdrawn high enough to allow the end of the tailpipe assembly string to be pulled from the lateral wellbore and then lowered into the main wellbore through the premilled window of the "hook" liner hanger system.

The end (or bottom) of the tailpipe assembly string is then lowered down into the main wellbore until that bottom is close to the whipstock packer which has been left in the main wellbore below the juncture of the main wellbore and lateral wellbore during the entire operation to prevent cement and other debris from falling below the whipstock packer into the main wellbore. Of course, this whipstock packer has preferably been plugged by known means. Reverse circulatory or other known means can be used to clean out any excess cement or other debris that may have fallen on top of the whipstock packer when the cement was pumped out of the cementing valve in the cementing operation.

The aforementioned camming surface and guide slot constitutes an important feature of this invention and operates as follows. The rotational orientation is accomplished downhole by the fixed position cam that is positioned above the junction of the wellbores (selected lateral and main). This cam is oriented down hole during installation of the "hook" liner hanger system in the juncture of the lateral wellbore with the main wellbore. A guide slot protrusion is mounted on either the bent sub or near the bottom part of a tool string, depending on which borehole is to be entered (main borehole or selected lateral borehole) and follows the cam automatically into the slotted guide which orients the bent sub so that the bent sub will either position the tool string to go into the lateral borehole or to remain in the main borehole to pass downhole below the lateral borehole. It should be noted that this system requires no rotational manipulation from the surface. It should be additionally noted that the slotted guide below the cam surface is sufficiently long enough so that the guide slot protrusion will orient the bottom of the tool string before the tool string reaches the juncture with the selected lateral wellbore.

When it is desired to keep the tool string in the main wellbore, the guide slot protrusion is mounted near the bottom of the tool string opposite the outside of the bend on the bent sub. The bend in the bent sub is oriented so that the bent sub will create a spring force pushing the guide slot protrusion against the main bore wall. The guide slot protrusion will contact the cam surface and orient the tool string in line with the slotted guide of the "hook" liner hanger system so that the bent sub is pushing the tip of the tool string away from the lateral wellbore and downhole in the main wellbore.

In an alternate embodiment of the hook liner hanger system of the invention the premachined window providing access to the primary bore further includes a short section of tubing, attached at an angle, to the hook liner. The angle is sufficient to allow the short section of tubing to substantially extend parallel to the primary bore subsequent to departure of the hook liner from the lateral window. The short section of tubing provides additional seal capability and because it merely extends from the hook liner by approximately 1½ to 2 inches the hook liner is still capable of being passed through the primary casing without difficulty.

Subsequent to installation of the hook liner into the lateral and the inherent orienting of the premachined window and the hook liner due to self centering of the hook on the lateral window, an orientation anchor is run through the hook liner and out the premachined window into communication with the original whipstock anchor such that the orientation anchor is oriented on the whipstock anchor and will ensure that the angled uphole section of the orientation anchor will be indexed with the premachined window of the hook liner. This provides for excellent sealability of the orientation anchor to the hook liner. A tie back seal is employed to seal the orientation anchor to the hook liner to increase performance of the unit. Alternatively, the anchor may be run prior to the hook liner and then drawn back uphole for sealing with the hook liner. This is effective but complicates the procedure.

The above-discussed and other features and advantages of the present invention will be appreciated by those skilled in the art from the following detailed description and drawings.

BRIEF DESCRIPTION OF THE DRAWINGS

Referring now to the drawings, wherein like elements are numbered alike in the several FIGS:

FIG. 12 is a longitudinal elevation view of a bent sub with a guide slot protrusion on the outside of the bend which forces the bent sub to enter a chosen lateral wellbore in accordance with the present invention;

FIG. 12A is a plan view along the line 12A—12A of FIG. 12 depicting the profile of the guide slot protrusion in accordance with the present invention;

FIG. 13 is a longitudinal elevation view of a bent sub with a guide slot protrusion mounted near the end of a bent sub assembly which forces the bent sub assembly to enter the main wellbore downhole of a lateral wellbore in accordance with the present invention;

FIG. 13A is a plan view along the line 13A—13A of FIG. 13 depicting the profile of the guide protrusion in accordance with the present invention which is identical to FIG. 12A;

DESCRIPTION OF THE PREFERRED EMBODIMENT

Figure 1:
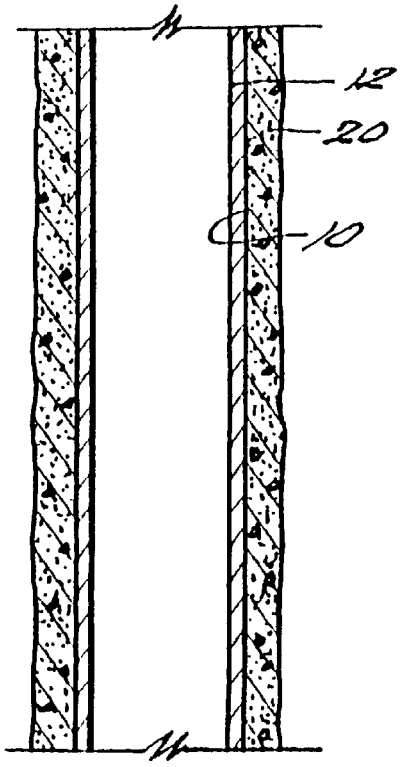
FIG. 1 is a cross-sectional elevation view of a cased borehole.
Figure 2:
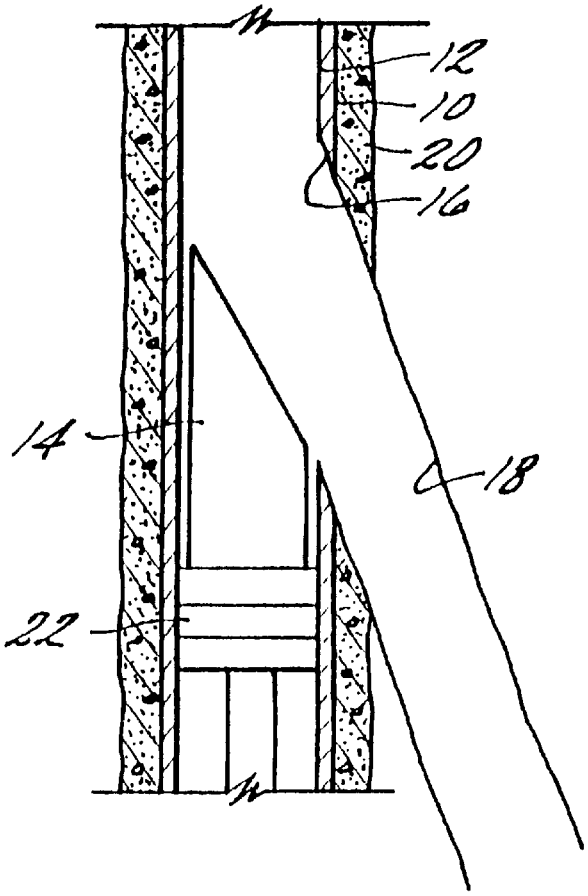
FIG. 2 is a cross-sectional elevation view of the cased borehole of FIG. 1 subsequent to milling of a window in the casing and the drilling of a lateral borehole.
Figure 3:
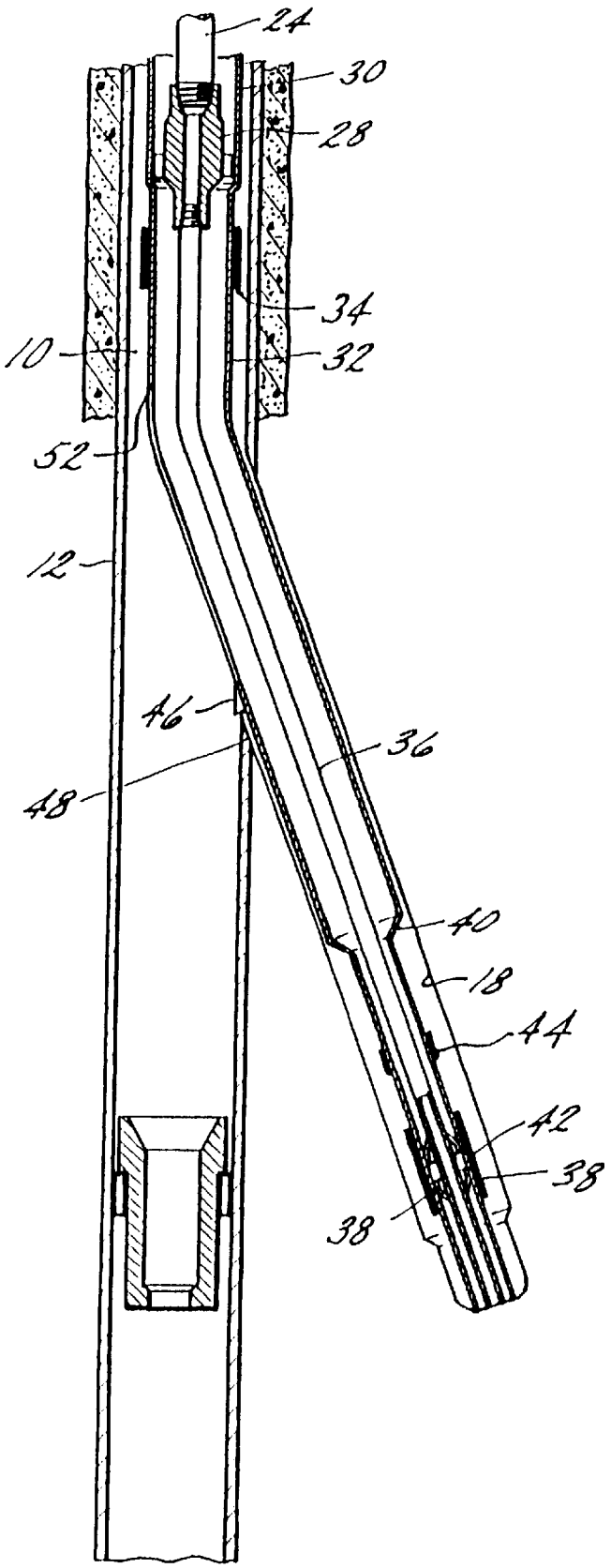
FIGS. 3–6 are sequential cross-sectional elevation view depicting the completion and cementing of the lateral borehole of FIG. 2.
Figure 4:
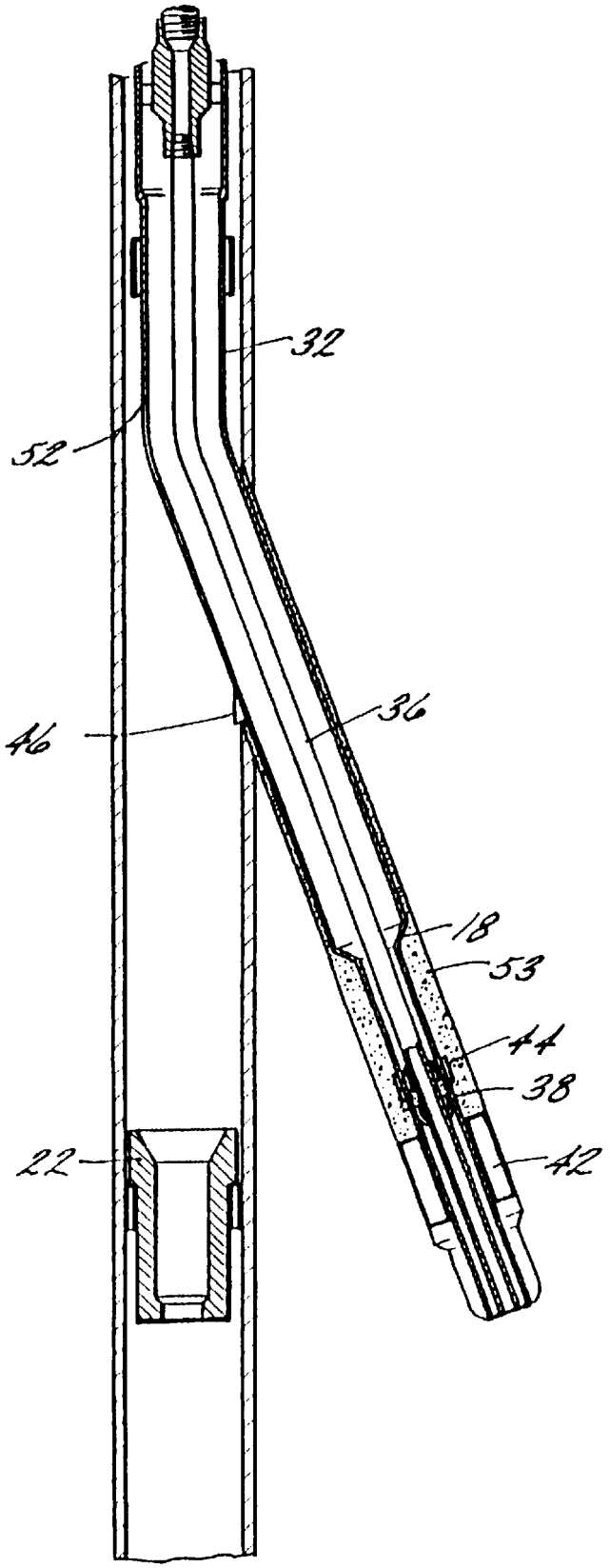
Figure 5:
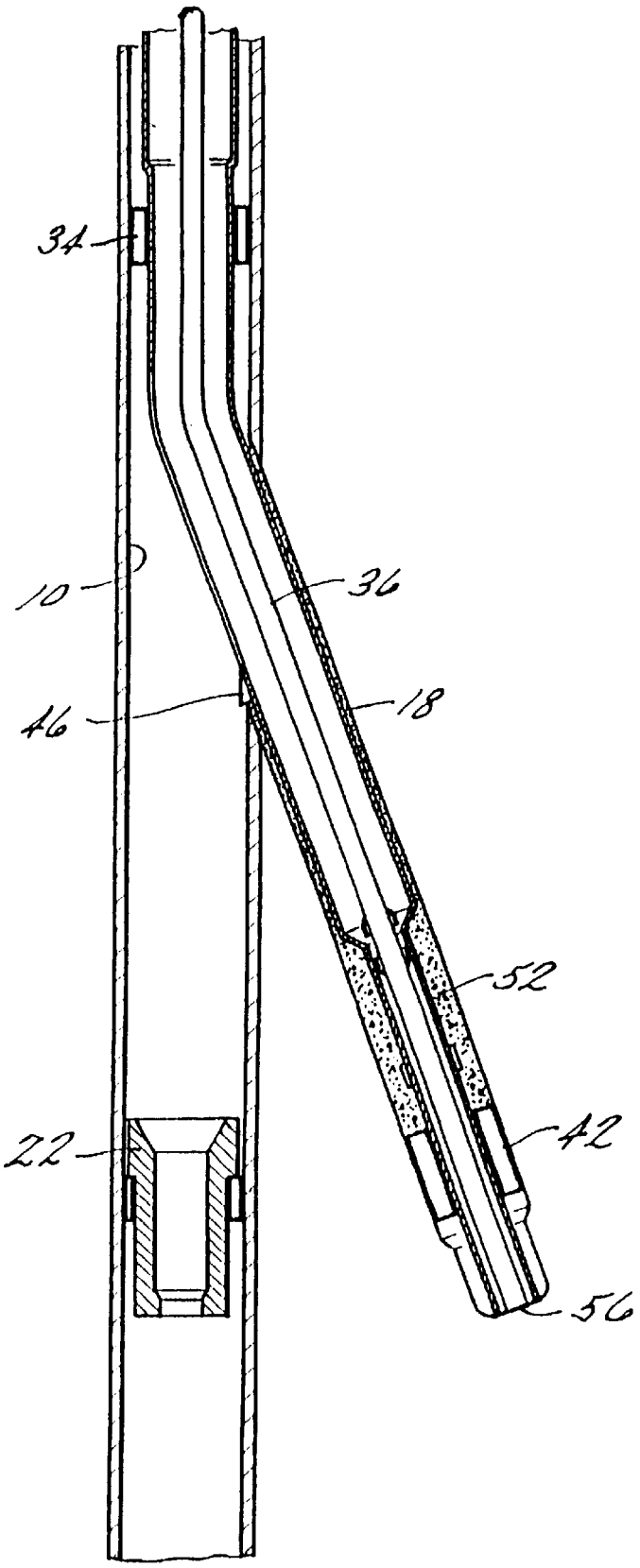
Figure 6:
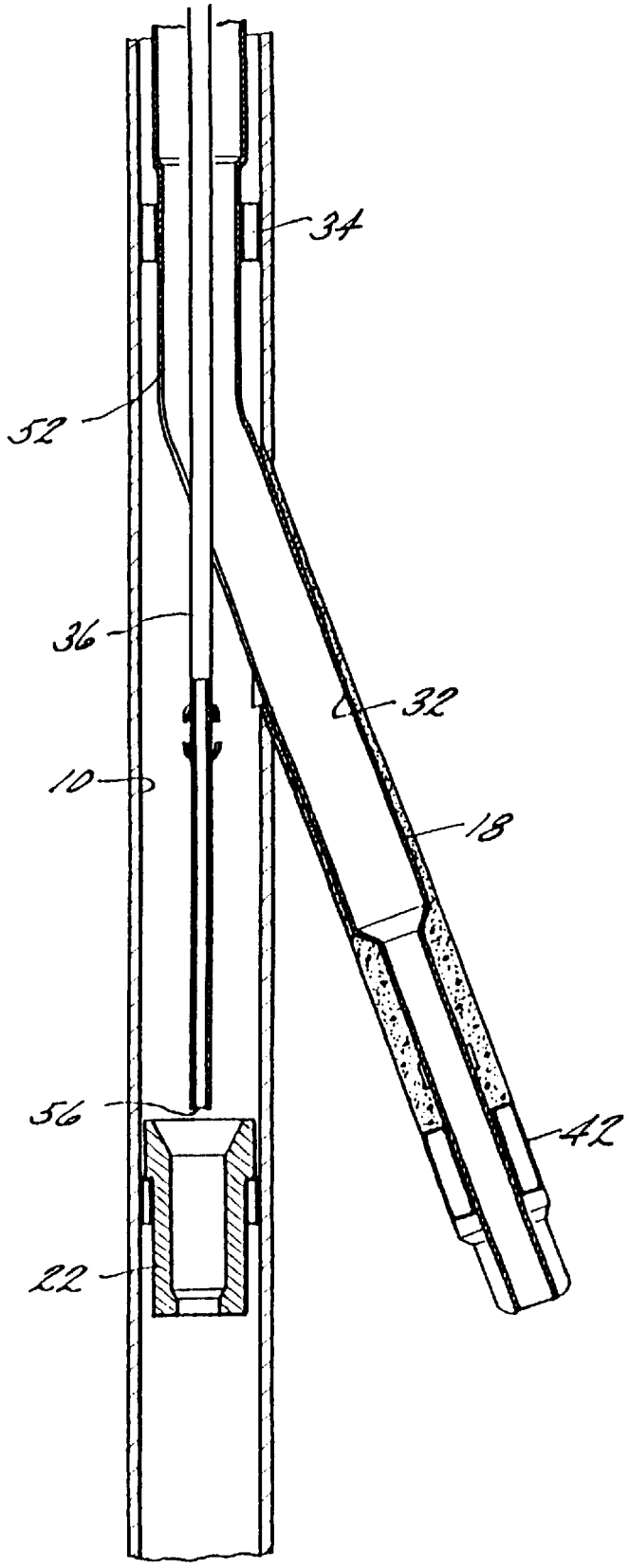
Figure 7:
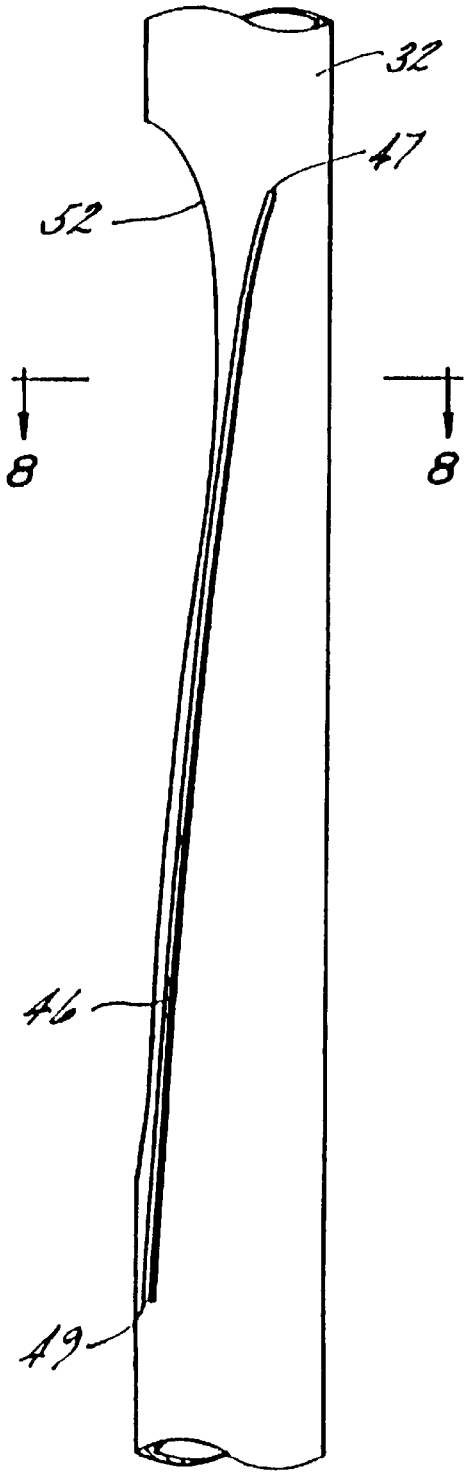
FIG. 7 is a longitudinal elevation view of the completion assembly used in FIGS. 3–6 and particularly depicting the "hook" liner hanger assembly.
Figure 8:
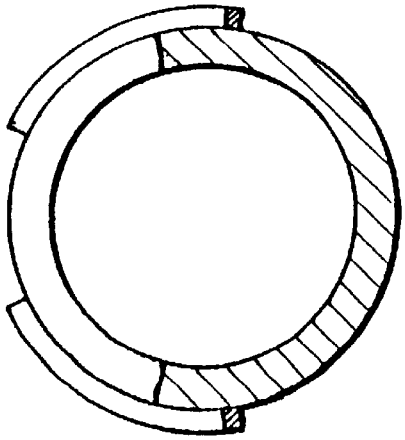
FIG. 8 is a cross-sectional elevation view along the line 8—8 of FIG. 7.

In accordance with the present invention, a method and device for completing lateral, branch or horizontal wells which extend from a single primary wellbore, and more particularly for completing multiple wells extending from a single generally vertical wellbore (multilaterals) is described. It will be appreciated that although the terms primary, vertical, deviated, horizontal, branch and lateral are used herein for convenience, those skilled in the art will recognize that the devices and methods of the present invention may be employed with respect to wells which extend in directions other than generally vertical or horizontal. For example, the primary or parent wellbore may be vertical, inclined or even horizontal. Therefore, in general, the substantially vertical well will sometimes be referred to as the primary well and the wellbores which extend laterally or generally laterally from the primary wellbore may be referred to as the branch wellbores.

This invention discloses a preferred method of drilling, cementing and completing lateral wellbores extending from a parent or primary wellbore.

Referring first to FIGS. 1–8, it is noted that the description of the preferred embodiment in reference to FIGS. 1–8 is identical to and fully described in detail in U.S. Pat. No. 5,477,925, which is also commonly assigned to the assignee hereof and has been incorporated by reference. Please refer to U.S. Pat. No. 5,477,955 for a detailed description of FIGS. 1–8.

It should be noted that all details as disclosed in U.S. Pat. No. 5,477,955 are identical to the present invention except that the "hook" hanger liner system 32 is replaced with the cam and slotted guide "hook" liner hanger system generally shown at 100 in FIG. 9. Cam and slotted guide "hook" liner hanger system 100 is comprised of a cam surface 102, a slotted guide section 104, a main bore window 106, and a lateral sleeve section 108.

The cam and slotted guide "hook" liner hanger system in accordance with this invention is similar to the "hook" liner hanger system disclosed in U.S. Pat. No. 5,477,925 except that the section above the "hook" has a cam or leading edge 102 that tapers down to a slotted guide 104 which is designed to receive a guide slot protrusion (shown at 116 in FIGS. 12 and 13) mounted on either a bent sub or other tool depending on whether the main borehole or a lateral borehole is to be entered by the tool string or other device.

The advantages of the "hook" liner hanger system in accordance with the present invention are multiple. First and foremost, this approach allows for automatic orientation of the tool string to enter the selected lateral or main borehole. Additionally, this approach to selective re-entry of any borehole allows for larger full sized borehole laterals compared with that of the prior art. Additionally, this approach eliminates the orientation operation as required by the prior art and thus saves considerable time and expense when it is desired to enter either a selected lateral borehole or the main borehole as desired.

Referring now to FIGS. 9–15, the novel selective re-entry system for multi-lateral wells in accordance with the present invention will be discussed in detail hereinafter. Basically, this system enables selective entry by the rotational orientation of a bent sub or other tool in a tool string.

Figure 10:
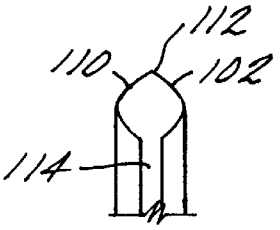
FIG. 10 is a plan view along the line 10—10 of FIG. 9 depicting the cam of FIG. 9.

The cam surface 102 is milled or otherwise fabricated by known methods on the uphole edge of slotted guide section 104 with a suitably known taper 110 that leads around from the tip 112 to slotted guide 114 (best seen in FIG. 10). It should be noted that any suitable profile may be used for cam surface 102 which successfully allows a guide slot protrusion 116 mounted on either the outside bend of a known bent sub or at the end of a tool string to automatically orient the tool string without manipulation from the surface to enter a selected lateral wellbore or the main wellbore as desired.

Figure 11:
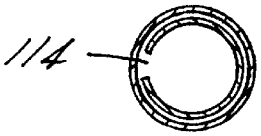
FIG. 11 is a cross-sectional view along the line 11—11 of FIG. 9 depicting clearly the slotted guide of FIG. 9.
Figure 9:
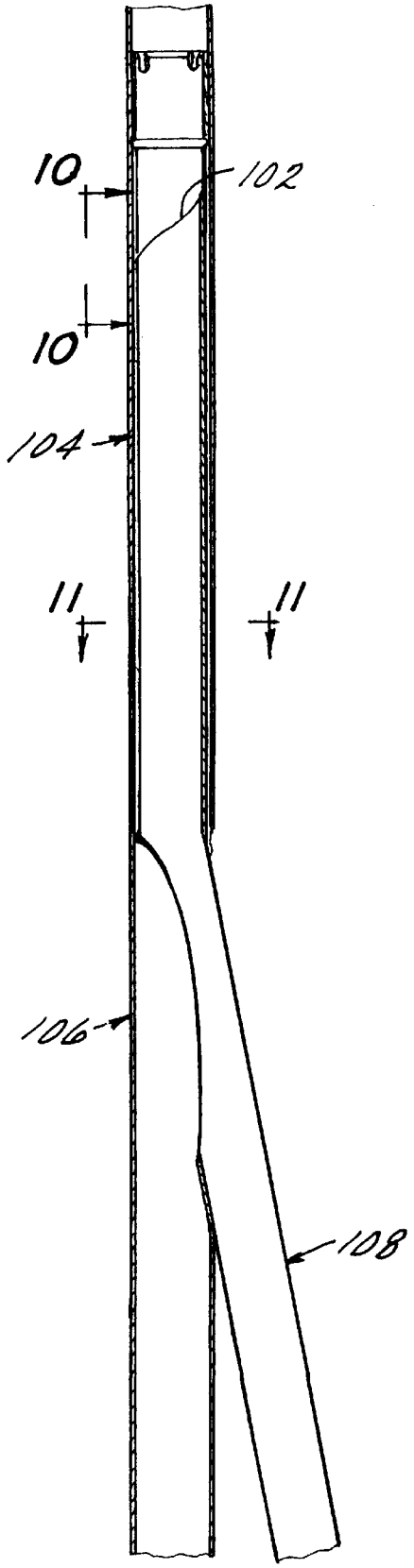
In FIG. 9 is a cross-sectional elevation view depicting the novel cam and slotted guide "hook" liner hanger system in accordance with the present invention installed in position in a main and lateral wellbore junction prior to the completion and cementing of the lateral wellbore junction in accordance with FIG. 3–6.

The slotted guide 114 is milled or otherwise fabricated by known means along the entire length of the slotted guide section 104 of cam and slotted guide "hook" liner hanger system 100 which terminates in main bore window 106 (see FIGS. 9–11). Slotted guide 114 is sized to accept a suitably sized protrusion 116. It should be noted that other suitable profiles or shapes for the slotted guide 114 and protrusion 116 may be used so that a multiplicity of lateral wellbores could be automatically entered from the surface and thus increase the versatility of the present invention. More particularly, selective profiles in either or both of the guide section 104 or the protrusion 116 may be employed to allow the advancing re-entry system to selectively skip or engage profiles. Careful determination of the profiles will allow for a substantial number of down hole laterals to be easily selectively accessed.

The remainder of cam and slotted guide hook liner hanger system 100, including main bore window 106, lateral sleeve section 108 and the "hook" hanger mechanism are identical to and fabricated in the same manner as those same portion of the "hook" hanger liner system 32 of U.S. Pat. No. 5,477,955.

Figure 14:
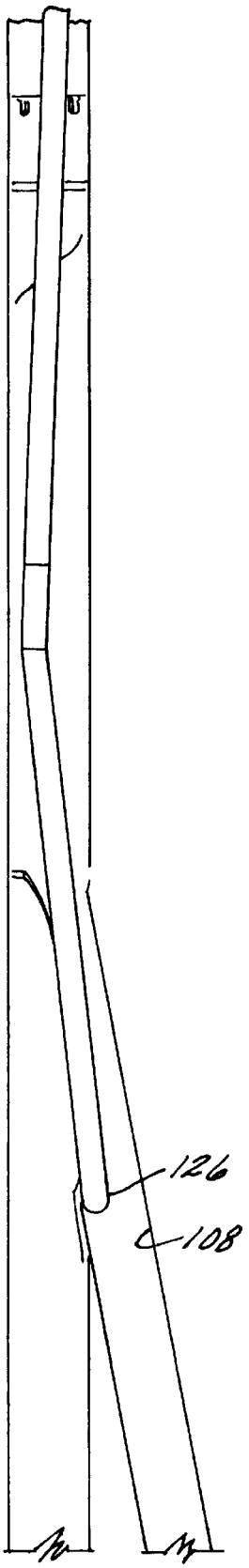
FIG. 14 is a longitudinal cross-section elevational view of a wellbore juncture depicting how the guide slot protrusion of FIG. 12 forces the end of the bent sub assembly to enter a lateral wellbore.

Turning now to FIGS. 12, 12A and 14, the guide slot protrusion 116 in accordance with this invention is shown attached to the outside bend 118 of bent sub 120 which is situated on a tool string 122. Guide slot protrusion 116 is preferably of rectangular shape which tapers to triangular points 122, 124 which permits relatively good frictionless engagement as guide slot protrusion 116 is moving up or downhole in slotted guide 114. Because of the pressure exerted by the guide slot protrusion 116 on the bottom of the slot 114, the tip 126 of tool string 122 is forced to enter lateral sleeve section 108 (best seen in FIG. 14). It should be noted that there are other suitable profiles for guide slot protrusion 116 and slotted guide 114.

Figure 15:
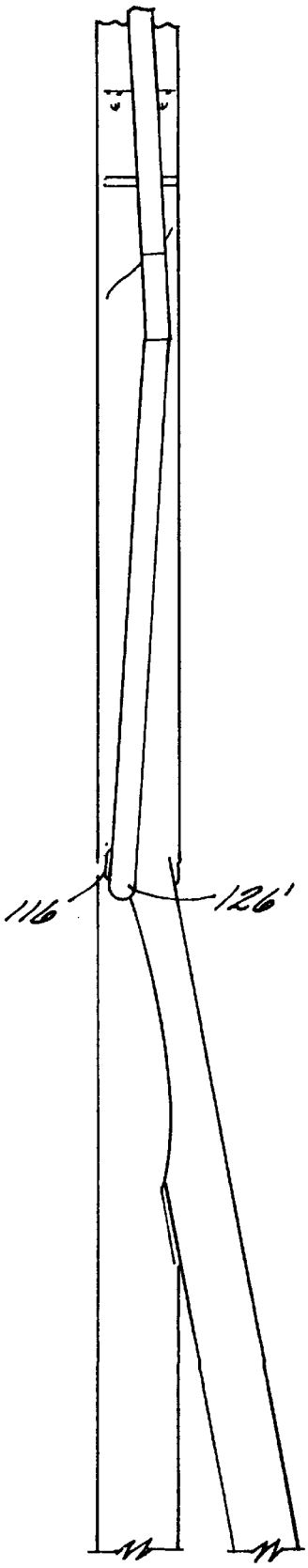
FIG. 15 is a longitudinal cross-section elevational view of a wellbore juncture depicting how the guide slot protrusion of FIG. 13 forces the end of the bent sub assembly to enter the main wellbore downhole of a lateral wellbore.

In FIGS. 13, 13A and 15, the same guide slot protrusion 116, is affixed near the end of tool string 122' by known means opposite the outside bend 118 of bent sub 120 on the tip 126' of tool string 122'. At the surface, the tool string 122' is oriented so that the guide slot protrusion 116 when engaged in slotted guide 114 will by means of the pressure exerted by the outside bend 118 of bent sub 120 on the inside casing wall opposite the side containing the slotted guide 114. The tool string 122' is guided downhole by slotted guide 114 and because of the aforementioned pressure, tool string 122' is automatically forced to enter main bore window 106 of the cam and slotted guide "hook" liner hanger system 100 to proceed downhole beyond lateral sleeve section 108 as can be clearly seen in FIG. 15.

Figure 16:
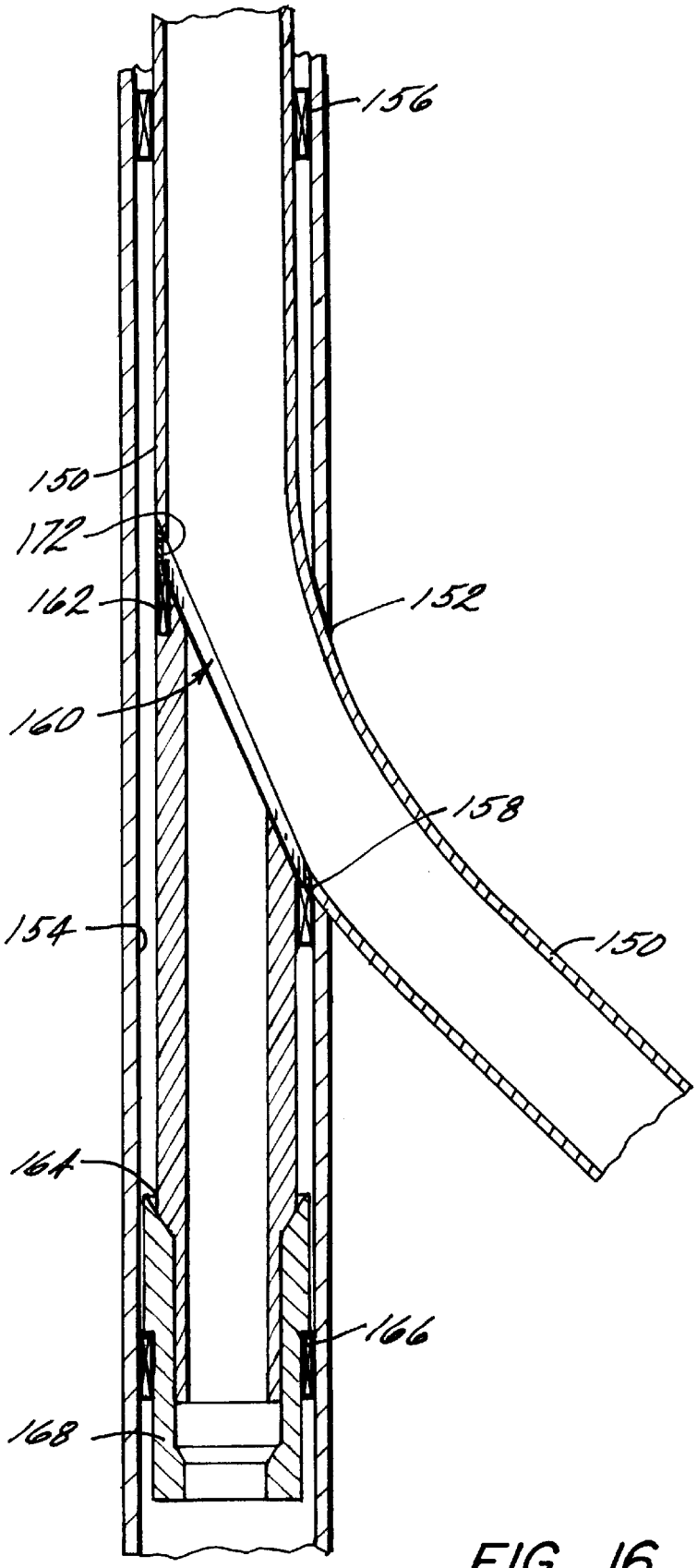
FIG. 16 is a schematic representation of a related embodiment of the invention providing for sealing of the junction of a hook liner hanger lateral system.

Referring to FIG. 16, one of ordinary skill in the art will appreciate that the hook liner 150 is in position within the milled window 152 of primary casing 154 and has been sealed with liner packer 156. Having been inherently oriented by the self centering movement of hook 158 in the window opening, premachined window 160 is coaxial with the downhole extension of primary casing 154. In order to provide a substantially superior hook liner hanger, a tie back seal 162 is utilized to seal an orientation anchor tube 164 to liner 150. It should be noted that orientation anchor 164 includes an orientation lug 166 which is complimentary to the receiving pattern in the original whipstock packer 168. This ensures that the angled section 170 of orientation anchor 164 is appropriately aligned with window 160 of the hook liner 150. As will be appreciated by one of ordinary skill in the art, failing proper orientation of the orientation anchor, the angled opening 170 would interfere with the lumen of the lateral. Short tube 172 is attached to the hook liner prior to installation of the hook liner and the borehole and provides 1½ to 2 inches of sealing surface coaxial to primary casing 154. This increases the reliability of the seal created by tie back seal 162.

It is important to note that orientation anchor 164 may be installed prior to installing the hook liner or subsequent thereto. In the event that the orientation anchor is installed prior to installation of the hook liner 150 the operator must merely install the liner 150 and then draw the orientation anchor 164 back up into the window 160 for sealing thereof. Alternatively, if orientation anchor 164 is installed subsequent to the hook liner being installed, the orientation anchor 164 is simply tripped downhole through the upper section of liner 150 and out of window 160 until it contacts and communicates with the whipstock packer so that orientation is perfected. It is at this time that the tie back seal 162 is actuated by hydraulic pressure, mechanical actuation, or electrical actuation according to known methods. Alternatively, the seal may be self actuated by being compressed for sealing the orientation anchor 164 to short tube 172 and thereby the lateral liner 150. It should be appreciated that tie back seal 162 may be a packer or other inflatable element, an interference seal or a chevron-type seal. It is also noted that other types of seals which are capable of performing substantially the same function are also contemplated.

The arrangement of the invention is beneficial to increase performance of the well since the formation is sealed from the I.D. of the hook hanger at three critical points. The O.D. of the hook hanger to the lower main bore is sealed with the anchor 164 and whipstock packer 168; the connection between the tie back mandrel and the hook hanger is sealed with a tie back seal 162; and the top of the hook hanger is sealed around the O.D. thereof and the I.D. of the primary casing 154 with the liner packer 156. Setting of the mechanism of the invention can be by set down force or edge technology as described in U.S. Ser. No. 08/595,884 which is assigned to the assignee hereof and incorporated herein by reference or by other conventional means.

While preferred embodiments have been shown and described, various modifications and substitutions may be made thereto without departing from the spirit and scope of the invention. Accordingly, it is to be understood that the present invention has been described by way of illustrations and not limitation.

We claim:

1. In a multilateral well at least having a primary and a lateral wellbore a reentry tool comprises:

an orienter having a cam surface and a slot, said orienter being positioned near said at least one lateral wellbore such that a string being run in and having an orientation lug at a predetermined position thereon is automatically properly oriented to continue in one of the primary wellbore and the lateral wellbore.

2. A method for automatic selective reentry of one of a lateral wellbore and a primary wellbore comprising:

installing an orienter in proximity to a primary/lateral junction;

fitting a bent sub on a string being run into said primary wellbore, said bent sub having a lug in a selected location to facilitate entry to one of said lateral wellbore and said primary wellbore;

running said string in and landing said lug on said orienter and allowing said lug to be funneled by said orienter into a slot therein whereby said bent sub is oriented to enter one of said lateral and said primary.

3. A method for automatic selective reentry of one of a lateral wellbore and a primary wellbore as claimed in claim 2 wherein said lug is positioned proximate a leading end of said bent sub whereby said string is directed into said primary wellbore.

4. A method of automatic selective reentry of one of a lateral wellbore and a primary wellbore as claimed in claim 2 wherein said lug is positioned on an outer radius of the bend in said bent sub whereby said string is directed into said lateral wellbore.

5. A system for automatically selectively reentering one of a lateral wellbore and a primary wellbore comprising:

an orienter disposed in said primary wellbore proximate said lateral wellbore;

a bent sub attached to a string and acting as a leading edge of said string, said bent sub having a lug selectively positioned on said sub such that upon passing said string downhole within said primary wellbore, said lug contacts said orienter, said orienter channeling said lug into a slot in said orienter whereby said bent sub is oriented to enter one of said lateral wellbore and said primary wellbore.

6. A system for automatically selectively reentering one of a lateral wellbore and a primary wellbore as claimed in claim 5 wherein said lug is positioned near a leading end of said bent sub and is aligned with an inside radius of a bend in said bent sub whereby said bent sub will enter said primary wellbore.

7. A system for automatically selectively reentering one of a lateral wellbore and a primary wellbore as claimed in claim 5 wherein said lug is positioned on the outside radius of said bent sub whereby said bent sub will enter said lateral wellbore.

8. A system for automatically selectively reentering one of a lateral wellbore and a primary wellbore as claimed in claim 5 wherein said orienter has a helical cam surface.

* * * * *

UNITED STATES PATENT AND TRADEMARK OFFICE

CERTIFICATE OF CORRECTION

PATENT NO. : 5,944,108
DATED : August 31, 1999
INVENTOR(S) : John L. Baugh et al.

It is certified that error appears in the above-identified patent and that said Letters Patent is hereby corrected as shown below:

Column 3,
Line 67, after "wells", insert -- ( --

Column 4,
Line 42, delete "preferred" and insert therefor -- pre-formed --

Column 7,
Lines 41 and 44, after "No.", delete "5,477,955" and insert therefor --5,477,925 --

Column 8,
Line 42, delete "5,477,955" and insert therefor -- 5,477,925 --

Signed and Sealed this

Sixteenth Day of April, 2002

*Attest:*

*Attesting Officer*

JAMES E. ROGAN
*Director of the United States Patent and Trademark Office*